US010529176B1

(12) United States Patent
Hamilton

(10) Patent No.: US 10,529,176 B1
(45) Date of Patent: Jan. 7, 2020

(54) WAGERING GAME SYSTEM AND METHOD

(71) Applicant: Russell Hamilton, Las Vegas, NV (US)

(72) Inventor: Russell Hamilton, Las Vegas, NV (US)

(73) Assignee: Three Way Roulette, Ltd., Buffalo Grove, IL (US)

( * ) Notice: Subject to any disclaimer, the term of this patent is extended or adjusted under 35 U.S.C. 154(b) by 0 days.

(21) Appl. No.: 15/967,599

(22) Filed: Apr. 30, 2018

Related U.S. Application Data

(60) Provisional application No. 62/492,038, filed on Apr. 28, 2017, provisional application No. 62/586,163, filed on Nov. 14, 2017.

(51) Int. Cl.
*G07F 17/32* (2006.01)

(52) U.S. Cl.
CPC ..... *G07F 17/322* (2013.01); *G07F 17/3211* (2013.01); *G07F 17/3293* (2013.01)

(58) Field of Classification Search
None
See application file for complete search history.

(56) References Cited

U.S. PATENT DOCUMENTS 8,449,363 B2 * 5/2013 Baerlocher ..... G07F 17/3276 463/13
10,137,353 B2 * 11/2018 Stockinger ..... G07C 1/24
2013/0296025 A1 * 11/2013 Castle, II ..... G07F 17/32 463/25
2015/0206399 A1 * 7/2015 Shelburn ..... G07F 17/3293 463/22

* cited by examiner

*Primary Examiner* — Ronald Laneau
(74) *Attorney, Agent, or Firm* — Newman Law, LLC

(57) ABSTRACT

Systems and methods for providing a wagering game at a gaming table which includes receiving wagers, forming a group of community cards from a unique set of randomly-ordered physical playing cards or simulation thereof, and determining the outcome of wagers received wherein at least one wager is determined by comparing a first card of the group of community cards with a first wager winning criteria and at least one wager is determined by comparing the group of community cards including the first card with a second wager winning criteria.

2 Claims, 11 Drawing Sheets

38 CARD DOUBLE JOKER VERSION

252

POKER BETS

| | | |
|---|---|---|
| 1 | PAIR | |
| | - *6 TO KING* | 2 TO 1 |
| | - *ACES* | 6 TO 1 |
| 2 | STRAIGHT | 7 TO 1 |
| 3 | FLUSH | 11 TO 1 |
| 4 | STRAIGHT FLUSH | 40 TO 1 |
| 5 | THREE OF A KIND | 50 TO 1 |
| 6 | ROYAL JACKPOT | |
| | - *NATURAL ROYAL DIAMONDS* | 1,000 TO 1 |
| | - *NATURAL ROYAL ALL OTHERS* | 500 TO 1 |
| | - *ALL JOKER ROYAL FLUSHES* | 120 TO 1 |

ROULETTE BETS

| | | |
|---|---|---|
| 7 | JOKER BET | 35 TO 1 |
| 8 | SINGLE BET | 35 TO 1 |
| 9 | 2 WAY BET | 17 TO 1 |
| 10 | 3 WAY BET | 11 TO 1 |
| 11 | 4 WAY BET | 8 TO 1 |
| 12 | 6 WAY BET | 5 TO 1 |
| 13 | 12 WAY BET | 2 TO 1 |
| 14 | - 1ST 12<br>- 2ND 12<br>- 3RD 12 | 2 TO 1 |
| 15 | RED<br>BLACK | 1 TO 1 |

250

37 CARD SINGLE JOKER VERSION

252

POKER BETS

| | | |
|---|---|---|
| 1 | PAIR | |
| | - *6 TO KING* | 2 TO 1 |
| | - *ACES* | 8 TO 1 |
| 2 | STRAIGHT | 9 TO 1 |
| 3 | FLUSH | 14 TO 1 |
| 4 | STRAIGHT FLUSH | 80 TO 1 |
| 5 | THREE OF A KIND | 75 TO 1 |
| 6 | ROYAL JACKPOT | |
| | - *NATURAL ROYAL DIAMONDS* | 1,000 TO 1 |
| | - *NATURAL ROYAL ALL OTHERS* | 500 TO 1 |
| | - *JOKER ROYAL ALL* | 299 TO 1 |

ROULETTE BETS

| | | |
|---|---|---|
| 7 | JOKER BET | 35 TO 1 |
| 8 | SINGLE BET | 35 TO 1 |
| 9 | 2 WAY BET | 17 TO 1 |
| 10 | 3 WAY BET | 11 TO 1 |
| 11 | 4 WAY BET | 8 TO 1 |
| 12 | 6 WAY BET | 5 TO 1 |
| 13 | 12 WAY BET | 2 TO 1 |
| 14 | - 1ST 12<br>- 2ND 12<br>- 3RD 12 | 2 TO 1 |
| 15 | RED<br>BLACK | 1 TO 1 |

250

55 CARD WITH 3 JOKERS VERSION

252

POKER BETS

| | | |
|---|---|---|
| 1 | PAIR | |
| | - 2 TO KING | 3 TO 1 |
| | - ACES | 7 TO 1 |
| 2 | STRAIGHT | 10 TO 1 |
| 3 | FLUSH | 10 TO 1 |
| 4 | STRAIGHT FLUSH | 45 TO 1 |
| 5 | THREE OF A KIND | 80 TO 1 |
| 6 | JACKPOT | |
| | - JOKER-JOKER-JOKER | 1,000 TO 1 |
| | - ANY NATURAL ROYAL FLUSH | 500 TO 1 |
| | - ALL JOKER ROYAL FLUSHES | 250 TO 1 |

ROULETTE BETS

| | | |
|---|---|---|
| 7 | JOKER BET - Same as Single | 51 TO 1 |
| 8 | SINGLE BET | 51 TO 1 |
| 9 | 2 WAY BET | 25 TO 1 |
| 10 | 3 WAY BET | 16 TO 1 |
| 11 | 4 WAY BET | 12 TO 1 |
| 12 | 8 WAY BET | 5 TO 1 |
| 13 | 13 WAY BET | 3 TO 1 |
| 14 | RED OR BLACK | 1 TO 1 |

250

WAGERING GAME SYSTEM AND METHOD

BACKGROUND OF THE INVENTION

Field of the Invention

The present invention relates to the field of gaming, particularly to the field of wagering games involving random gaming implements, such as cards, and more particularly to modified and unique wagering games.

Background of the Art

The invention relates to the field of gaming, including electronic gaming machines and casino table wagering games.

The invention is directed to wagering games, and more particularly, modified wagering games having outcomes which can be determined by the results of one or more playing cards.

Gaming establishments or casinos continually require new games to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

SUMMARY OF THE INVENTION

Some embodiments of the invention are directed to a system for providing a wagering game at a gaming table, the system including one or more processors, display devices, data input devices, and memory, wherein the display device displays a gaming table layout with a plurality of defined areas representing wagers in the wagering game, wherein the defined areas include wagers having preset winning criteria satisfied by comparison with a single card and wagers having preset winning criteria satisfied by comparison with a plurality of cards; the processor being configured to simulate a unique set of randomly-ordered physical playing cards, wherein executable code in memory is executed to perform the following steps: receive one or more game wagers from one or more of the participating players, wherein the one or more game wagers are received by being physically positioned in a defined area; display cards from the set of randomly-ordered physical playing cards to form a group of community cards; determine the outcome of the wagers satisfied by comparison with a single card by comparing a first card of the group of community cards with the wager winning criteria; determine the outcome of the wagers satisfied by comparison with a plurality of cards by comparing all cards of the group of community cards with the wager winning criteria; and settle wagers by one of awarding a payout to the one or more participating players responsive to the satisfaction of a winning criteria, collecting the wager from the one or more participating players responsive to the failure to satisfy a winning criteria.

Some embodiments of the invention are directed to a method of providing a wagering game at a gaming table, the method comprising the steps of: providing a gaming table layout with a plurality of defined areas representing wagers in the wagering game, wherein the defined areas include wagers having preset winning criteria satisfied by comparison with a single card and wagers having preset winning criteria satisfied by comparison with a plurality of cards; providing unique set of randomly-ordered physical playing cards; receiving one or more game wagers from one or more of the participating players, wherein the one or more game wagers are received by being physically positioned in a defined area; distributing cards from the set of randomly-ordered physical playing cards to form a group of community cards; determining the outcome of the wagers satisfied by comparison with a single card by comparing a first card of the group of community cards with the wager winning criteria; determining the outcome of the wagers satisfied by comparison with a plurality of cards by comparing all cards of the group of community cards with the wager winning criteria; and settling wagers by one of awarding a payout to the one or more participating players responsive to the satisfaction of a winning criteria, collecting the wager from the one or more participating players responsive to the failure to satisfy a winning criteria.

Some embodiments of the invention are directed to a method of providing a wagering game associated with an underlying game involving at least two participating players at a gaming table, the method comprising the steps of: providing a set of randomly-ordered physical playing cards; receiving an associated game wager from one or more of the participating players; distributing cards from the set of randomly-ordered physical playing cards to form a group of community cards in the underlying wagering game; comparing the group of community cards with a preset amount of cards, wherein the outcome of the associated game wager is determined responsive to the amount of cards distributed to form the group of community cards being at least equal to a preset qualifying amount of cards; responsive to the amount of cards in the group of community cards being at least equal to the preset qualifying amount of cards, determining the outcome of the associated game wager for the one or more participating players, wherein the outcome of the associated game wager is determined by comparing the group of community cards with preset criteria, the preset criteria establishing at least a minimum poker ranking for the group of community cards; and settling the associated game wager independently of the results in the underlying game by one of awarding a payout to the one or more participating players from which an associated game wager is received responsive to the satisfaction of the preset criteria, collecting the associated game wager from the one or more participating players responsive to the failure to satisfy the preset criteria and returning the associated game wagers to the one or more participating players responsive to the underlying game ending prior to the group of community cards being at least equal to the preset qualifying amount of cards.

In some embodiments, the associated game wager differs in appearance from any of the wagers in the underlying wagering game and/or the placement of a representation of monetary value being placed in a designated area for the associated game wager on the gaming table.

Some embodiments of the invention are directed to a computer-facilitated method of providing a wagering game associated with an underlying game involving at least two participating players playing the underlying game together through computerized platforms including one or more processors, one or more display devices and one or more data communication devices, the method comprising the steps of: receiving an associated game wager from one or more of the participating players through the one or more data communication devices; displaying randomly generated playing cards on the one or more display devices to reveal a group of community cards in the underlying wagering game; the one or more processors facilitating comparing the group of community cards with a preset amount of cards, wherein the outcome of the associated game wager is determined responsive to the amount of cards distributed to form the group of community cards being at least equal to a preset qualifying amount of cards; responsive to the amount of cards in the group of community cards being at least equal to the preset qualifying amount of cards, the one or more processors determining the outcome of the associated game wager for the one or more participating players, wherein the outcome of the associated game wager is determined by comparing the group of community cards with preset criteria, the preset criteria establishing at least a minimum poker ranking for the group of community cards; and settling the associated game wager by communicating through the one or more data communication devices one of an award of a payout to the one or more participating players from which an associated game wager is received responsive to the satisfaction of the preset criteria, the collection of the associated game wager from the one or more participating players responsive to the failure to satisfy the preset criteria and the return of the associated game wagers to the one or more participating players responsive to the underlying game ending prior to the group of community cards being at least equal to the preset qualifying amount of cards.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION OF SOME EMBODIMENTS OF THE INVENTION

It should be understood that the invention is generally directed to systems, methods and apparatus for providing, operating, hosting and conducting interactive wagering games generally involving sequences of controlled and concrete transformative events or steps, the generation of random results or data, and the use and application of the randomly generated results in a manner which provides for the resolution of both prior and/or subsequent events or steps.

In the exemplary embodiments disclosed herein, the invention includes various steps such as those involving the receiving of wagers, provision of randomly generated gaming implements, distribution of the gaming implements according to preset formations and procedures, comparison of one or more of such formations with preset criteria, determining the outcome of wagers received and then settling the wagers depending on the determined outcome by one of either the following actions: collecting the wagers; distributing an award payout; and returning the wager received.

It should be understood that the words "wager," "wagering," "betting" or "bet," or the like, refers to any type of points, money, credits, items of value, including physical or virtual representations thereof, which are placed at risk in that they may be forfeit depending on the occurrence and application of randomly generated data. Additionally, it should also be understood that gaming implements may include standard or customized playing cards, joker cards and customized joker or other unique cards, and may be provided in a physical form, such as a set of randomly-ordered group of shuffled cards, or in a virtual form, such as a display device operatively associated with a processing device, memory and random number generator for creating a depiction of a gaming implement on the display device and generating random results to simulate the random results of physical gaming implements.

Each of the methods and individual steps recited herein may be partially or wholly carried out in a variety of ways and/or systems, which may include, but are not limited to, a live dealer physically dealing or using gaming implements in a casino, an electronic gaming machine (EGM) or kiosk for one or more players in which a live dealer distributes or uses gaming implements, such as cards, which may be in combination with a mechanism such as a camera or sensors for determining game outcomes by processing the random results with a data processor, or gaming implements are provided through a program which may include a random number generator, standalone multiplayer platforms which may include a player interface such as a touchscreen display and a physical or virtual gaming implements, through a home computer or portable computing device, such as a tablet computer or mobile phone capable of communicating with a network or over the Internet, global telecommunication network or world wide web.

Figure 1:
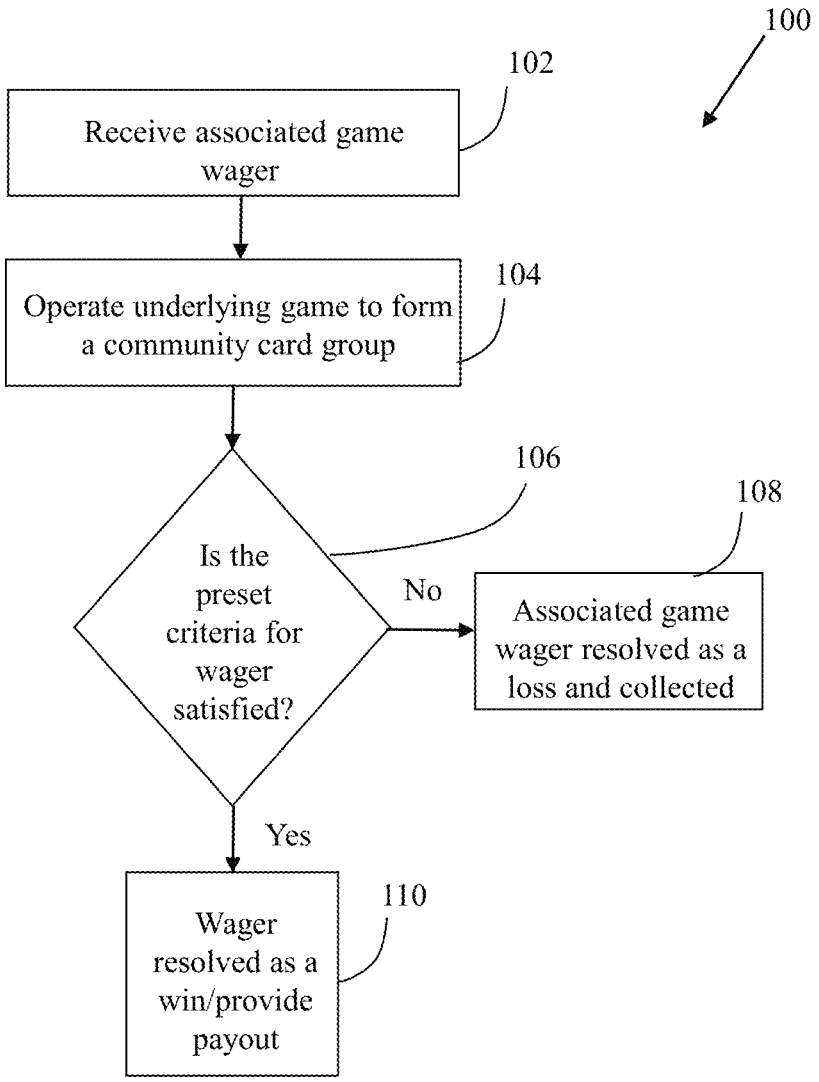
FIG. 1 is a process flow chart depicting an exemplary method for conducting a wagering game configured and constructed according to some embodiments of the invention.

FIG. 1 provides an exemplary embodiment of the invention for providing a wagering game generally referred to by the reference numeral 100. In this embodiment, a wagering game of the invention is associated with an underlying game involving players competing against one another and a community card group, with the associated wagering game being generally referred to by the reference numeral 100. For illustrative purposes, gaming method 100 will be discussed in connection the underlying game of Texas Hold'em poker. It should be readily apparent that gaming method 100 may be incorporated in other games in which players compete against other players and which include the formation of a community card group as part of the underlying game, such as variations of Texas Hold'em poker like Omaha Hold'em.

In step 102, an identifiable associated game wager is received from each player participating in the wagering game 100. An ante wager may also be received from one or more of the participating players relating to the underlying wagering game of this embodiment, such as the "big blind" and "small blind" ante wagers.

For purposes of this embodiment, receiving a wager generally involves the positioning of physical elements which represent monetary amounts (e.g., tokens or chips) in a designated area on the surface of a physical gaming table prior to the distribution or random generation of playing cards in the underlying game. The gaming table surface may include various areas designated thereon for placing wagers, including an associated wager area and an underlying game wager area, and for placing physical cards distributed to form the player hands and community cards.

The associated wagering game may be separately identifiable from the underlying wagering game. In this embodiment, the physical element used to wager, that is, the chip, or the designated area for receiving the associated game wager, may be configured such that the receipt of the associated game wager is immediately identifiable. For example, receiving an associated game wager can include placing a gaming chip which differs in physical appearance, such as color or design, from any and all of the gaming chips used in the underlying game. The gaming chip may be received by being placed in a designated area of the table layout which is reserved only for the associated game wager. Alternatively, the gaming table used for the underlying game may include a receiving port or unit, such as a drop box, for the placement of gaming chips or other implements for receiving the associated game wager.

In this embodiment, one or more fifty-two card standard decks of randomly-ordered physical playing cards are provided for use in the underlying game. The one or more decks may be hand-shuffled or shuffled via a card shuffling device. Cards from the one or more decks are distributed, such as to form partial hands for each participating player and used eventually reach an outcome in the underlying game. A community group of cards will be formed for purposes of the underlying game and the distribution of playing cards from the randomly-ordered decks thereto will determine the outcome of the associated wagering game.

In Texas Hold'em poker, two cards will be distributed to each participating player, upon which the first or second wagering event is conducted. Each wagering event provides an opportunity for each participating player to check (i.e., place no wager), wager, call (i.e., match a wager), enter an optional wager or raise. If an optional wager is received by a participating player, then that optional wager becomes a mandatory wager, and at least a matching wager must be received from any of the remaining participating players. If in addition to matching the wager, a participating player submits a raise, it will be considered in the same manner as the optional wager described herein, in that the raise or optional wager becomes a mandatory wager to all other participating players. If a mandatory wager is not received from a participating player, that participating player will no longer be a participating player in the game and forfeit any wagers placed during a wagering event and the ante wager. In this embodiment, a player forfeiting in the underlying game does not result in the player forfeiting in the associated wagering game. In other embodiments, the associated wagering game is also lost.

In step 104, the underlying game is operated and as a result a community group of cards is formed. In this embodiment, the formation of the community group involves the distribution of randomly generated playing cards to a defined area on the gaming table for use by all players in developing their hands in the underlying game.

As described with respect to the game of Texas Hold'em, the community group may be formed through a series of steps in the operation of the underlying wagering game involving distributing one or more cards to the group and then conducting additional wagering events until a complete community group is formed. However, in this embodiment, the community group of cards comprises the flop formed by dealing three cards face up to the designated area for the community group so that the identity of the cards are immediately made viewable to the participating players. In the game of Texas Hold'em, there are two additional cards dealt to the community card group, that is, the turn and the river or fourth and fifth streets, respectively, until the community group is completed with five cards. In some embodiments, the community card group comprises all five cards in the community group. A wagering event in the underlying game is provided between the dealing of the fourth and the fifth cards, and then a final wagering event after the fifth card is dealt.

As shown by step 106, the cards in the community group will be compared with a preset criteria for the associated game wager.

The preset criteria may relate to any data available from the community card group, including information regarding the playing cards, such as the ranks, suits and the order in which they were dealt in the underlying game.

For example, the preset criteria may relate to any one or more of a minimum poker ranking, such as a pair, the colors of the cards, such as all red, all black, two black and one red, or two red and one black, etc., and may include multiple poker rankings, such as two pair, straight, flush, etc., and a payout amount or multiple associated with each rank achieved by the community group, or in this embodiment, the three card flop part of the community group. It should be readily apparent that the preset criteria may vary and be modified in accordance with the invention and depending on the data obtainable from the underlying game outcome.

As shown by step 108, if the cards in the community card group of step 106 do not satisfy the preset criteria, then the outcome of the associated game is determined to be a loss, and the wager received in step 102 is resolved as a loss and collected. The associated game wager is therefore collected from each and every participating player from which an associated game wager was received in step 102. Collection of the wager in this embodiment may include the physical removal of the gaming chip from the associated wagering game area defined on the gaming table surface.

As also shown by step 110, if the cards in the community card group of step 106 satisfies the preset criteria, then the outcome of the associated game is determined to be a win, the wager received in step 102 is resolved and settled as such and a payout is provided in step 110 accordingly. The payout in step 110 may be anything of value, such as a fixed amount, a multiple of the wager received in step 102, an odds-based payout, all or a portion of an incremented progressive award or a prize. The payout is awarded to each and every participating player from which an associated game wager was received in step 102, regardless of the results of in the underlying game, that is, whether the player has won or folded and lost in the underlying game. The awarding of the payout may include the physical placement of gaming chips in the associated wagering game area defined on the gaming table surface.

In step 102, an initial pre-roll result wager is received from one or more players. This step may involve receiving multiple initial pre-roll result and thereafter, additional, secondary, post-initial roll result wagers as discussed herein.

Figure 2:
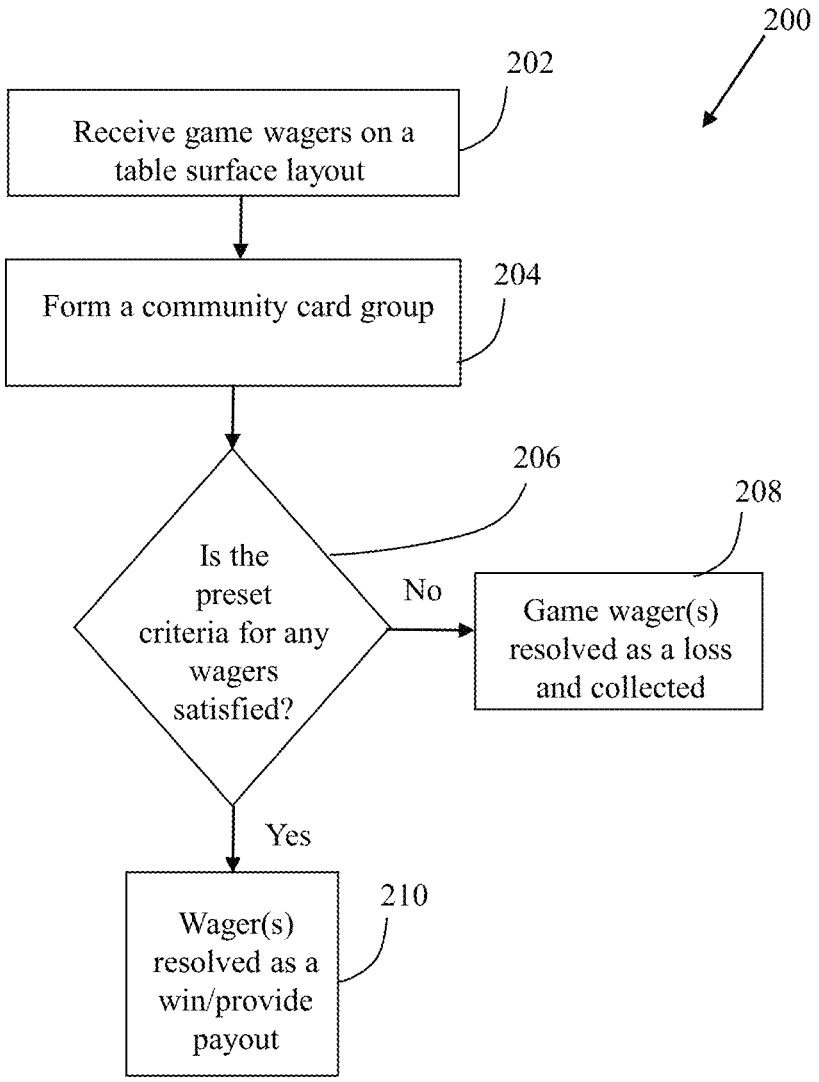
FIG. 2 is a process flow chart depicting another exemplary method for conducting a wagering game configured and constructed according to some embodiments of the invention.

FIG. 2 provides another exemplary embodiment of the invention for providing a wagering game generally referred to by the reference numeral 200. Wagering gaming method 200 is similar to the above, with the associated wagering game being the wagering game itself played with a unique table layout, such as the table layouts shown in FIGS. 3A, 3B and 3C.

In step 202, one or more identifiable game wagers are received from each player participating in the wagering gaming method 200. A wager may be received by indicating the same on the layout, which may display each possible card in a game deck. Thus, the preset criteria that must be satisfied to win this wager is one of the cards in the community group matching the card on the layout in which the wager is physically placed, or in embodiments involving a display device, electronically represented on the display upon the player selecting the location on the displayed layout. A wager may be received on the community card group formed in step 204 achieving a preset criteria, such as a poker rank. One or more of the cards may be dealt face up or down, but once revealed, are compared with the relevant and applicable preset criteria in step 206 with winning wagers being paid in step 210 and losing wagers being collected in step 208.

Figure 3A:
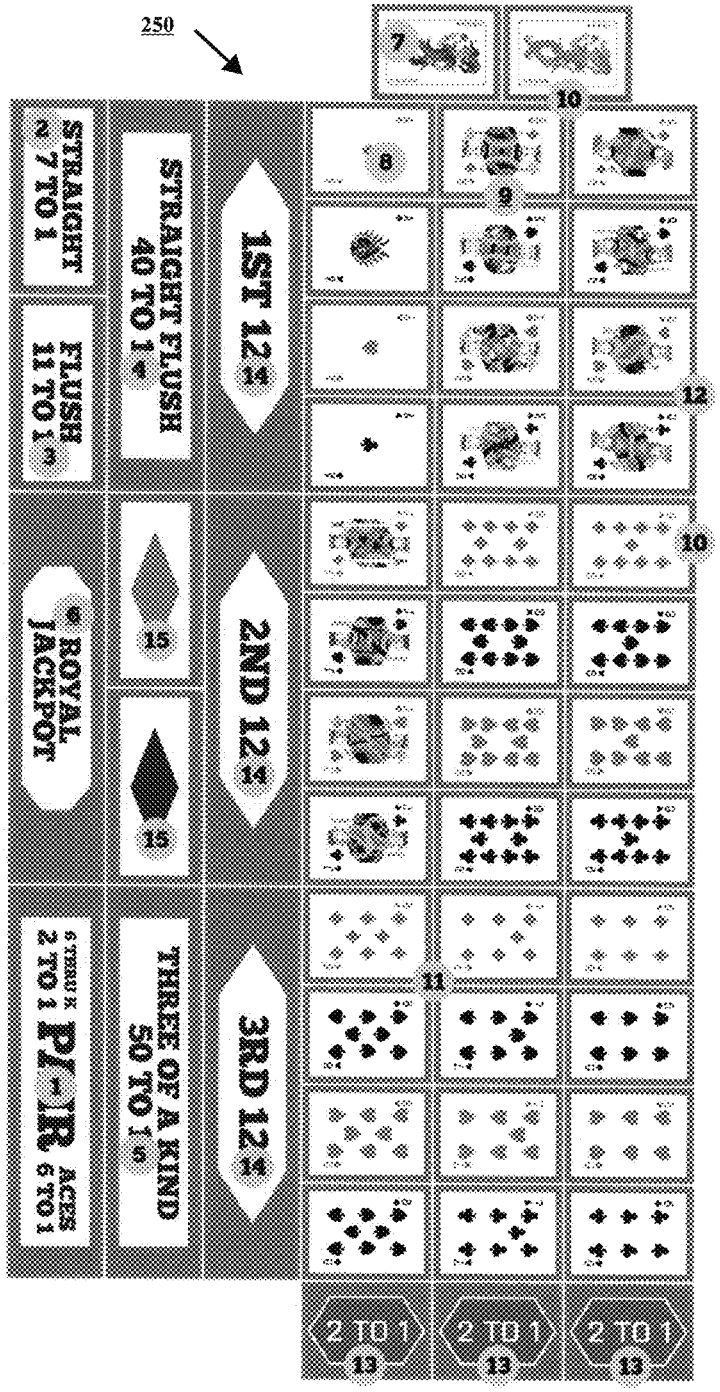
FIG. 3A is a diagram of a playing surface for implementation of a method of providing a wagering game, according to an embodiment of this disclosure.
Figure 3B:
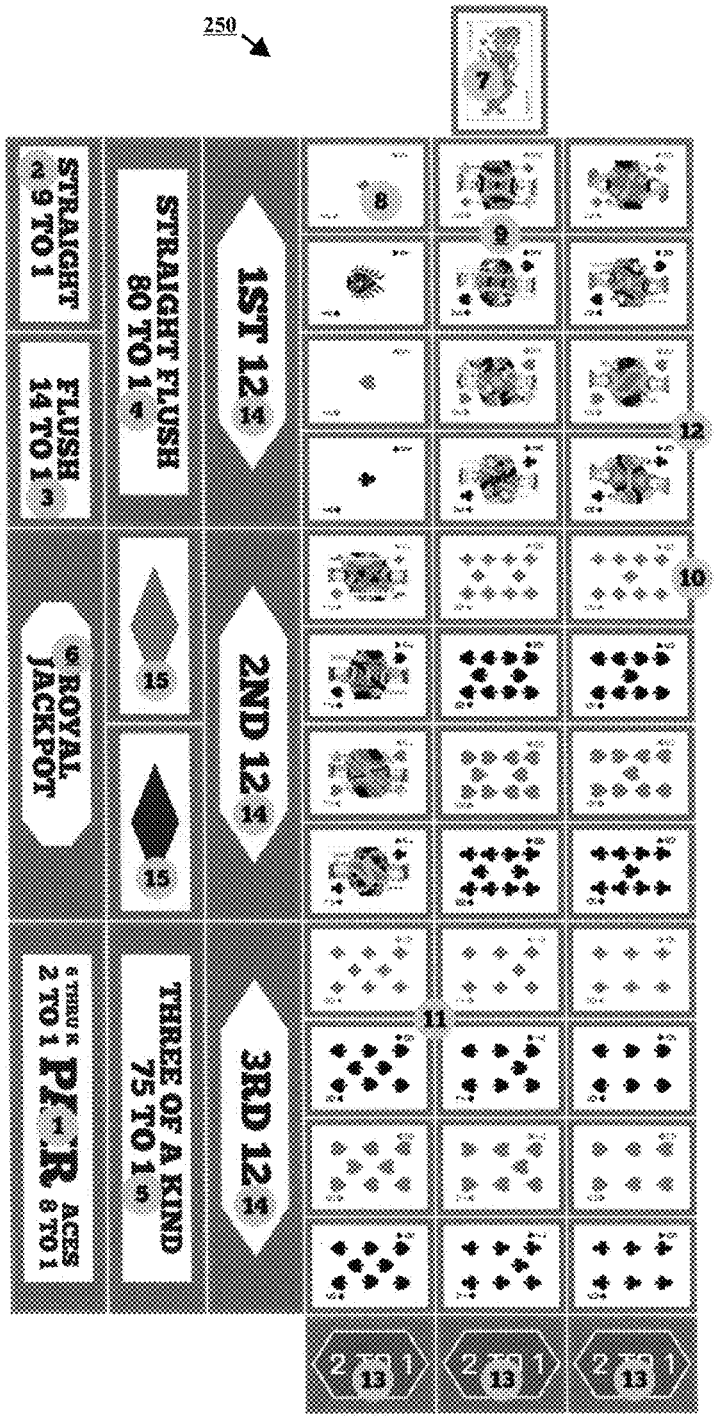
FIG. 3B is a diagram of a playing surface for implementation of a method of providing a wagering game, according to an embodiment of this disclosure.
Figure 3C:
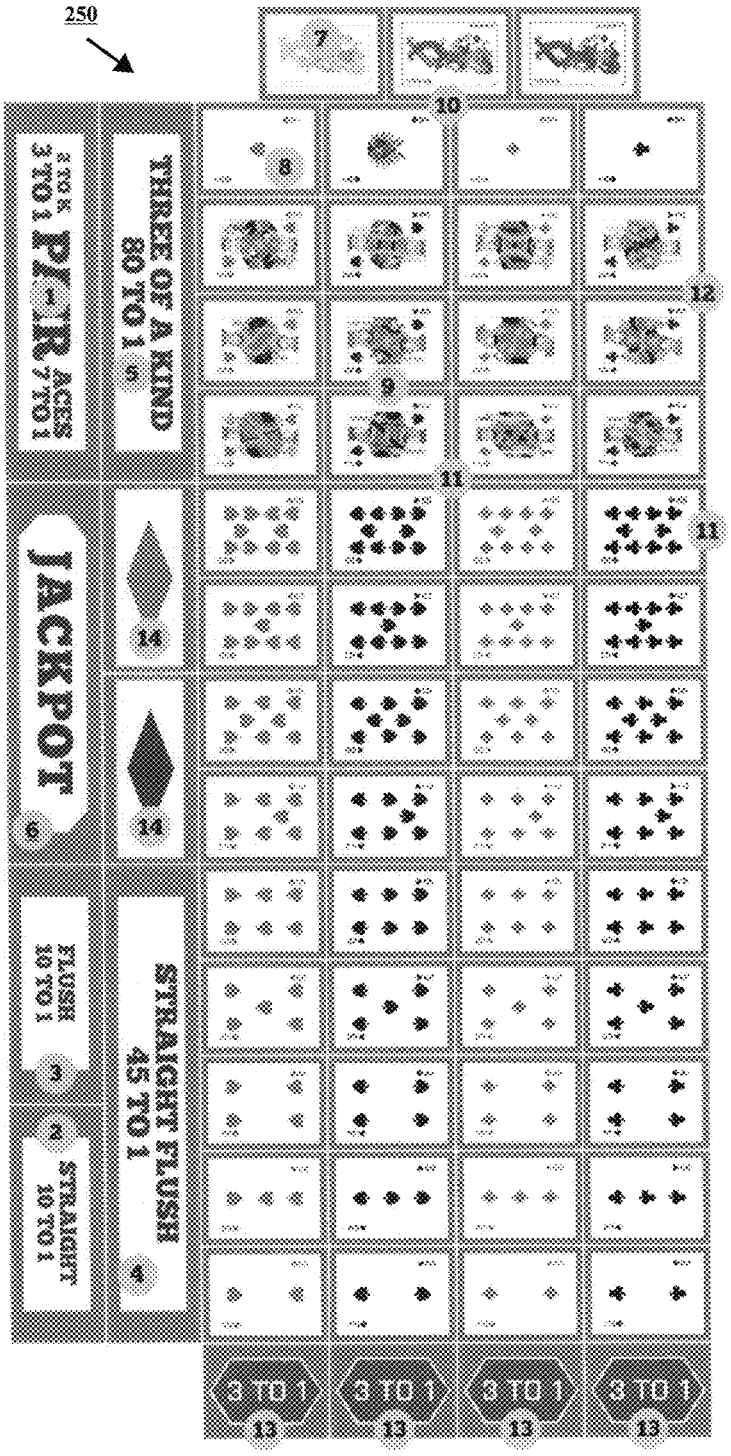
FIG. 3C is a diagram of a playing surface for implementation of a method of providing a wagering game, according to an embodiment of this disclosure.

Referring to FIGS. 3A, 3B and 3C, diagrams of a playing surfaces 250A, 250B and 250C, respectively, for implementation of the wagering games within the scope of the present disclosure. Each surface 250A-C includes multiple areas for placement of wagers, which each area representing a wager on one or more cards in the community group. The amount of areas defined may also reflect the amount of cards in the game deck. For example, some game decks may include 37, 38 or 55 cards, including one or more jokers, which the surface resembling that of roulette thus allowing wagers which may be similar to roulette. A display area 252 may illustrate the types of wagers, which in this embodiment are referred to as "poker" and "roulette" wagers, along with locations thereof for placement of wagers (that is, the physical chip or virtual representation thereof) for each respective wager on the surface 250A-C. Upon play of the game, as discussed with regard to method 200, a card shuffler containing the respective game deck with the cards as shown on the surface 250A-C, is activated to shuffle the game deck. One or more cards may be discarded before three cards are dealt to resolve all wagers. In some embodiments, the first card deal is used to resolve any "roulette" wagers defined in display area 252, and the first, second and third cards are used to resolve any "poker" wagers defined in display area 252.

Figure 4:
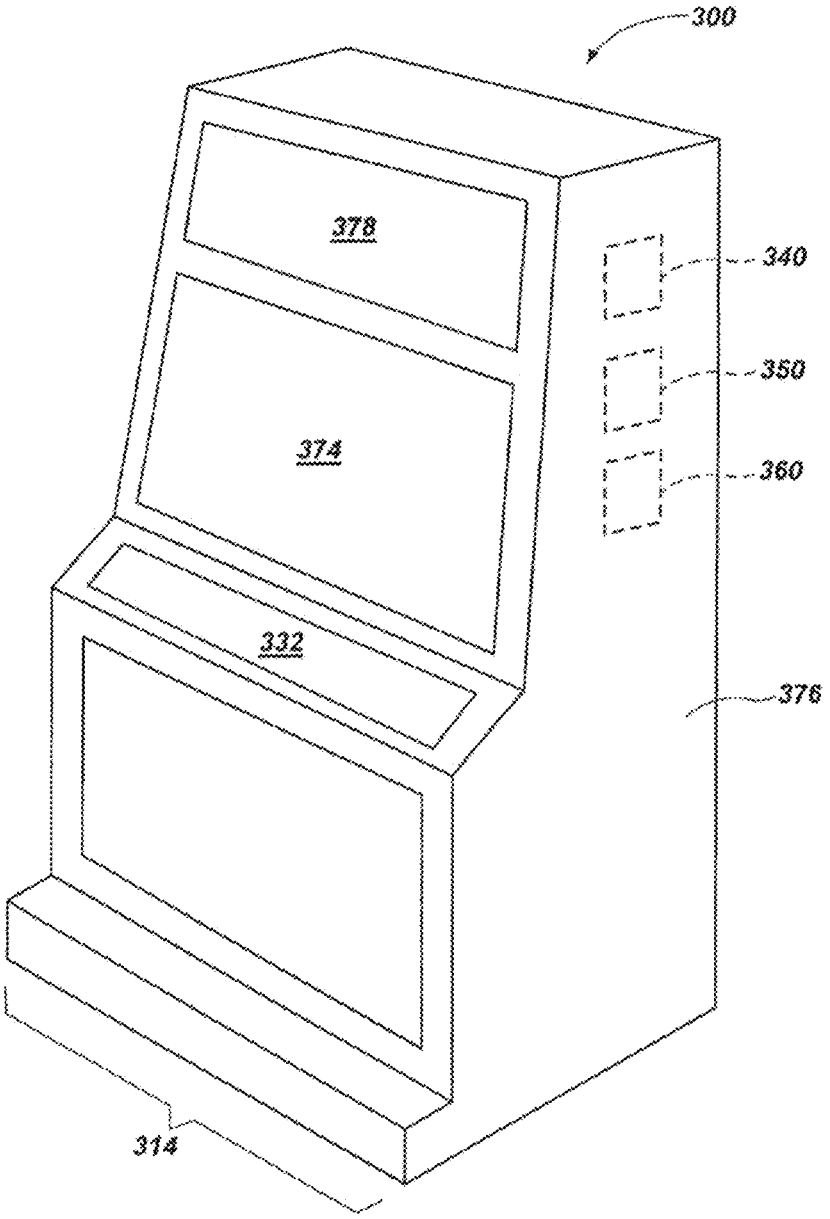
FIG. 4 is a perspective view of an individual electronic gaming device configured for implementation of embodiments of wagering games in accordance with this disclosure.

FIG. 4 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical cards, chips or other wagering elements, and live personnel. The action may instead be simulated by a control processor 350 operably coupled to the memory 340 and interacting with and controlling the individual electronic gaming device 300.

Although the individual electronic gaming device 300 displayed in FIG. 4 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices such as a server through a suitable communication medium, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play.

Some embodiments may be implemented at locations including a plurality of player stations. Such player stations may include an electronic display screen for display of game information (e.g., wagers and game instructions) and for accepting wagers and facilitating credit balance adjustments. Such player stations may, optionally, be integrated in a table format, may be distributed throughout a casino or other gaming site, or may include both grouped and distributed player stations.

Figure 5:
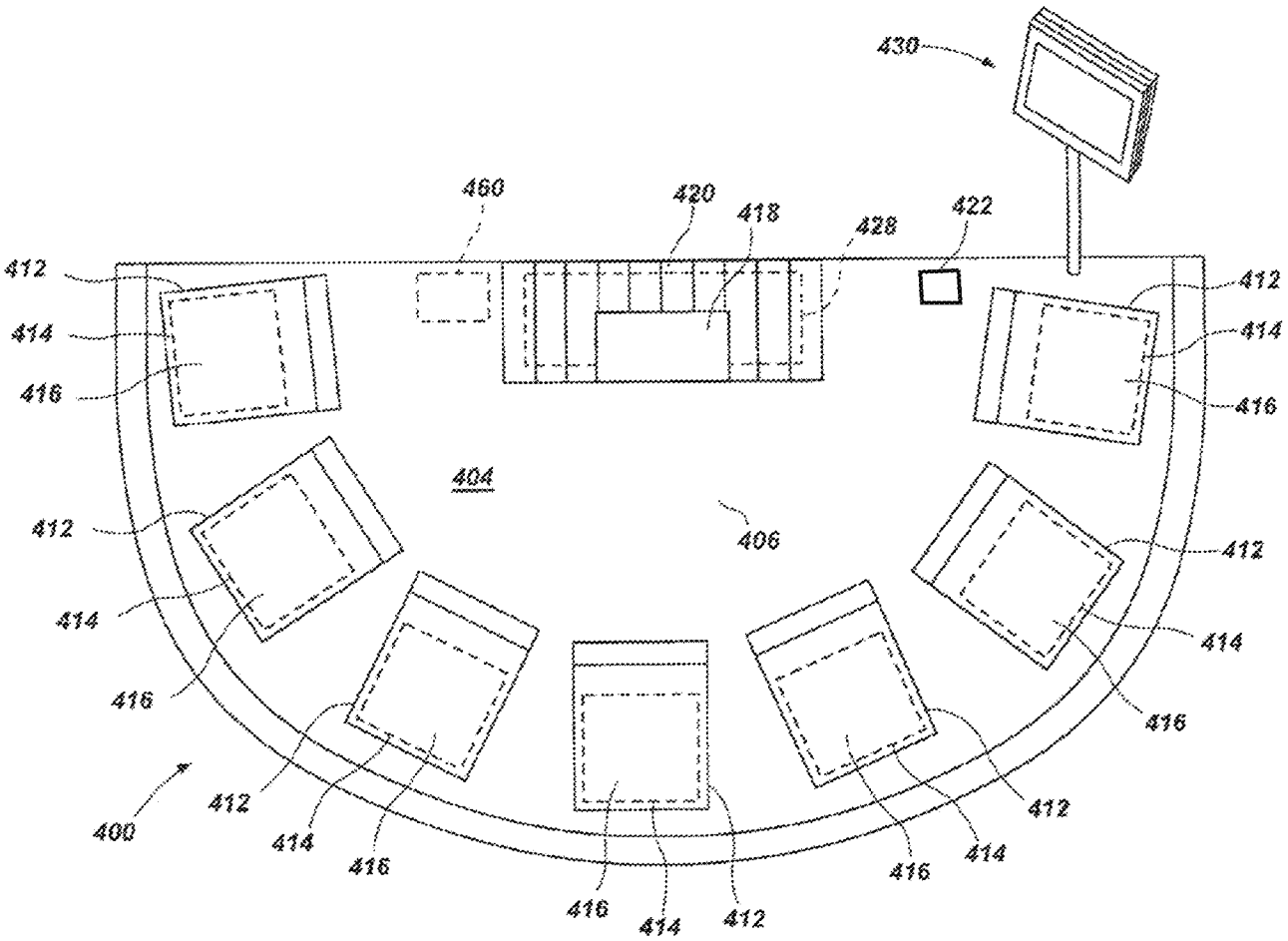
FIG. 5 is a top view of a table configured for implementation of embodiments of wagering games in accordance with this disclosure.

FIG. 5 is a top view of a suitable table 400 configured for implementing wagering games according to this disclosure. The table 400 may include a playing surface 404. The table 400 may include player stations 412. Each player station 412 may include a player interface 416, which may be used for displaying game information (e.g., game instructions, input options, wager information, game outcomes, etc., and accepting player elections). The player interface 416 may be a display screen in the form of a touch screen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

Table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers). For embodiments using physical cards, the table 400 may further include a tumbler or may include an automated electromechanical card shuffler 422 for automatically shuffling and reading the results and displaying them on a display, such as display 430 described further below. A designated area 406 for the results may include lights under the gaming table surface which illuminate based on the card results determined by device 422. Players may use the individual player interfaces 416 to initiate a game. For embodiments using virtual cards, the virtual cards may be displayed at the individual player interfaces 416.

Table 400 may further include a dealer interface 418, which, like the player interfaces 416, may include touch screen controls for receiving dealer inputs and for assisting the dealer in administering the wagering game. The table 400 further includes upright display 430 configured to display images that depict game information, which may include pay tables, game results, wager outcomes, historical win/loss information by player, and a wide variety of other information considered useful to the players.

Although an embodiment is described showing individual discrete player stations, in some embodiments, the entire playing surface 404 may be an electronic display, that may appear as gaming surface 250, and which is logically partitioned to permit game play from a plurality of players for receiving inputs from, and displaying game information to, the players, the dealer, or both.

Figure 6:
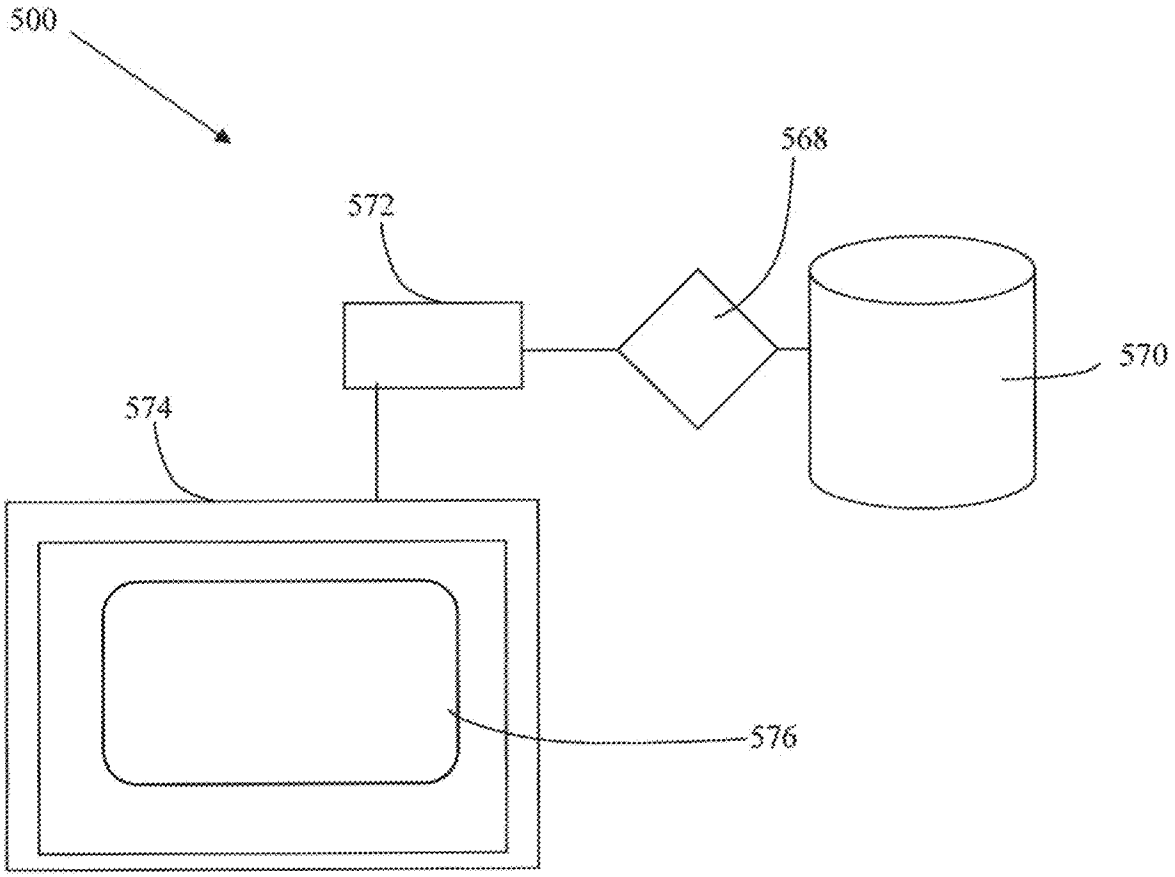
FIG. 6 is a schematic diagram depicting the components of an exemplary system configured and constructed according to some embodiments of the invention.

FIG. 6 illustrates a diagram of an exemplary system 500, which may be a portable device, constructed in accordance with some embodiments of the invention. System 500 includes processing device 568 in communication with a database or memory device 570, communication or data input/output device 572 and a display device 574. In some embodiments, display device 574 is a touch-enabled device and includes a data input device component. Memory device 570 may include data relating to the underlying game and embodiments of the invention as described herein, such as the wager outcome criteria. A player interface 576 can be presented on display device 574. Player interface 576 may be a virtual representation of a game table layout such as surface 250 and/or one or more player positions 252 for facilitating the transmittal and receipt of wagers in accordance with any of the embodiments herein, such as methods 100 or 200. Game outcomes are displayed and wagers are tracked using display device 574 and processing device 568 compares the cards with the relevant wager outcome criteria, and determines an outcome and payout to be displayed on display device 574 accordingly.

Figure 7:
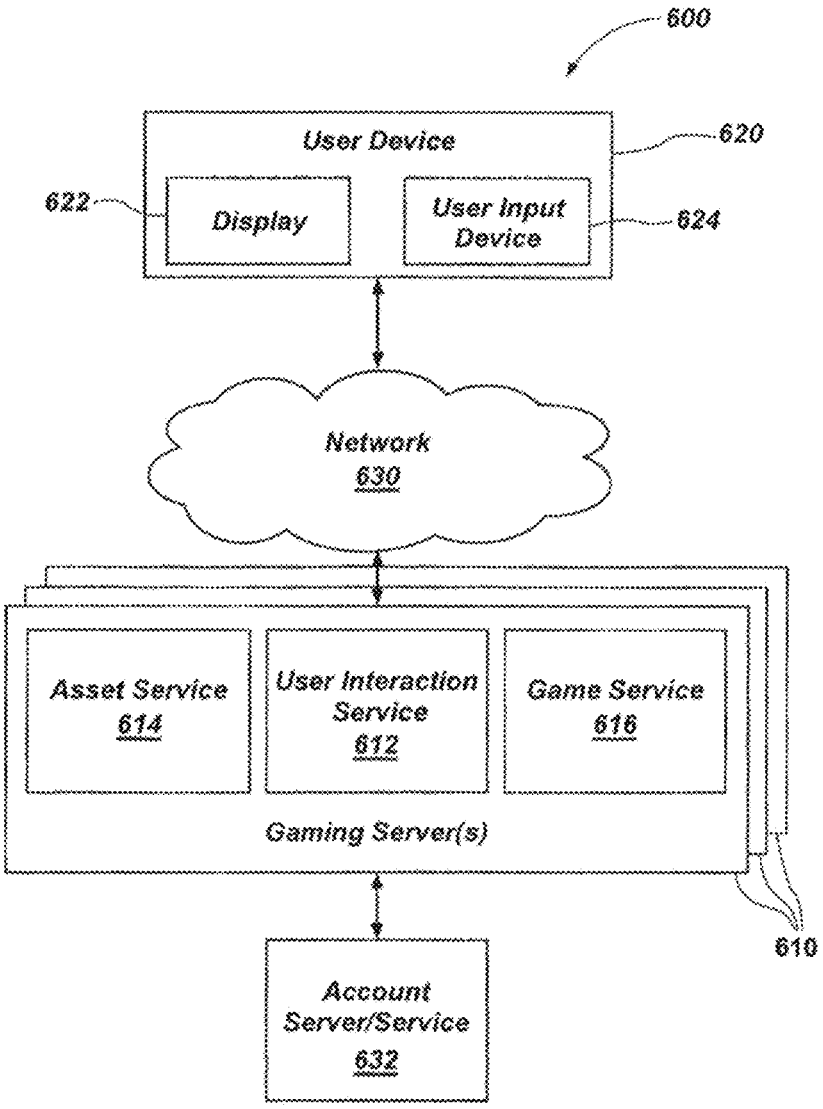
FIG. 7 is a schematic block diagram of a gaming system for implementing embodiments of waging games in accordance with this disclosure.

In some embodiments, wagering games in accordance with this disclosure may be administered using a gaming system employing a client-server architecture (e.g., over the Internet, a local area network, etc.). FIG. 7 is a schematic block diagram of an exemplary gaming system 600 for implementing wagering games so that end users may remotely access games as described herein, among others.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically the user device is remote from the gaming server 610 and the network is the word-wide web (i.e., internet).

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 7, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may comprise game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script, also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include pay tables and other game logic. The game service 616 may perform random number generation for determining random cards for the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming system 300 (see FIG. 4) or portable system 500 (see FIG. 6), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations.

Figure 8:
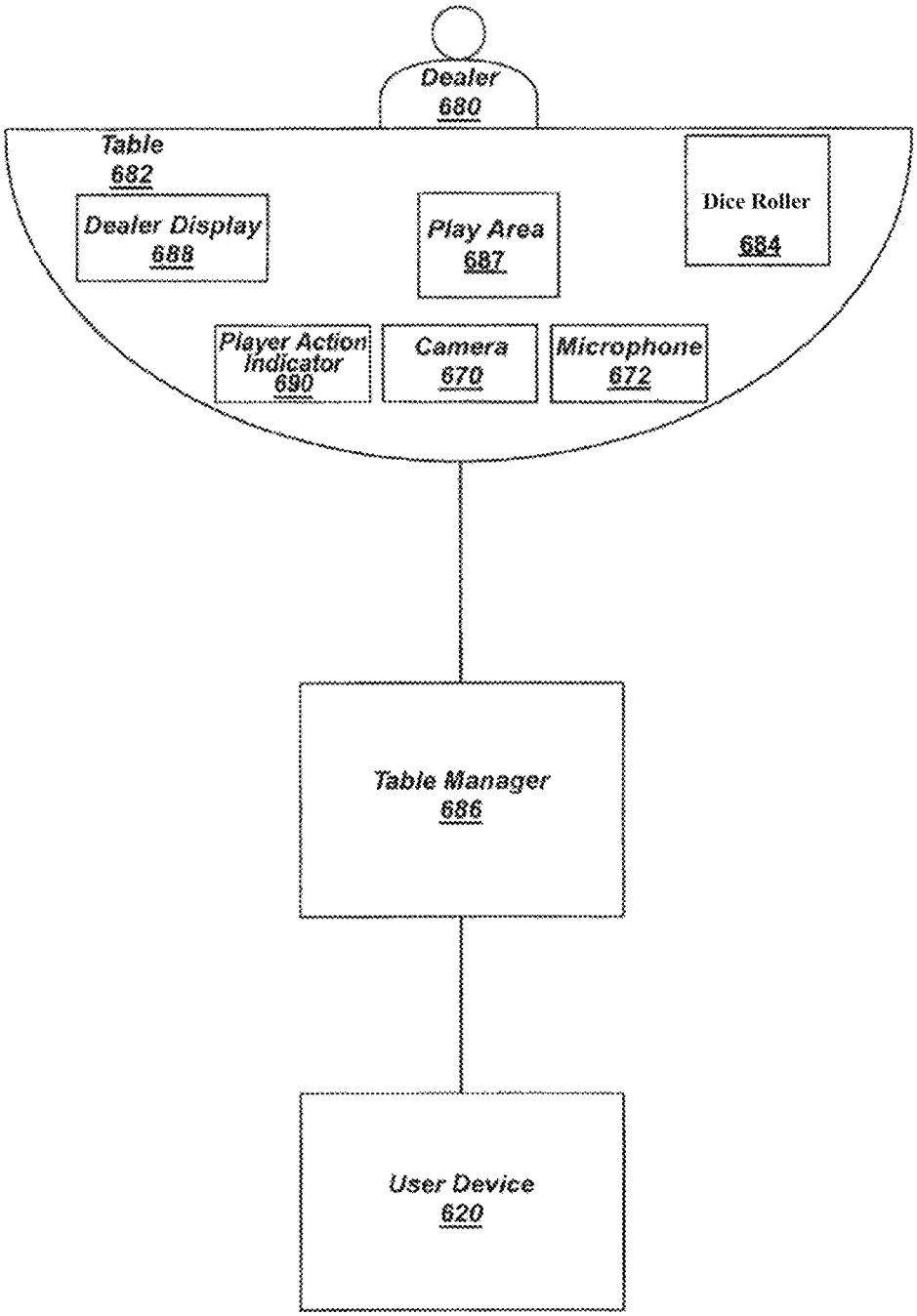
FIG. 8 is a schematic block diagram of a gaming system for implementing embodiments of wagering games including a live dealer feed.

FIG. 8 is a schematic block diagram of a table 682 for implementing wagering games including a live dealer feed. Features of the gaming system 600 described above in connection with FIG. 7 may be utilized in connection with this embodiment, except as further described. Rather than cards being determined by a computerized random processes, physical cards may be dealt by a live dealer 680 at a table 682 using a card shoe or shuffler 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 itself or as an intermediate client interposed between and operationally connected to the user device 620 and the gaming system 600 to provide gaming at the table 682 to users of the gaming system 600. Thus, the table manager 686 may communicate with the user device 620 through network 630, and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600, such as the one shown and described in connection with FIG. 7. In some embodiments, the gaming system 600 may match remotely located players to tables 682 and facilitate transfer of information between user devices 620 and tables 682, such as wagers and wagering amounts, without managing gameplay at individual tables. In other embodiments, functions of the table manager 686 may be incorporated into a gaming system 600.

The table 682 includes a camera 670 and optionally a microphone 672 to capture video and audio feeds relating to the table 682. The camera 670 may be trained on the dealer 680, play area 687, and a shuffler 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the cards, chips, and chip stacks on the surface of the gaming table and perform card recognition routines to identify the card results.

Game results and wager data in some embodiments may be used by the table manger 686 to determine wager outcomes. The data extracted from the camera 670 may be used to confirm the game results and for general security monitoring purposes.

The live video feed permits the dealer to show cards dealt and play the game as though the player were at a live casino. In addition, the dealer can prompt a user by announcing outcomes and opportunities to place certain wagers. In embodiments in which a microphone 672 is included, the dealer 680 can verbally announce actions or outcomes. In some embodiments, the user device 620 also includes a camera or microphone, which also captures feeds to be shared with the dealer 680 and other players.

The play area 687 may depict a player positions for playing the game, such as surfaces 250A, 250B or 250C. As determined by the rules of the game, the player at the user device 620 may be presented options for responding to an event in the game using a client as described with reference to FIG. 7.

Player selections may be transmitted to the table manager 686, which may display player elections to the dealer 680 using a dealer display 688 and player action indicator 690 on the table 682.

In some embodiments, the table manager 686 may receive game information such as the specific cards dealt. The table manager 686 may apply game rules and wager outcome criteria to the information to determine gameplay events, such as the occurrence of a series ending event, and wager results. Alternatively, the wager results may be determined by the dealer 680 and input to the table manager 686, which may be used to confirm automatically determined results by the gaming system.

Figure 9:
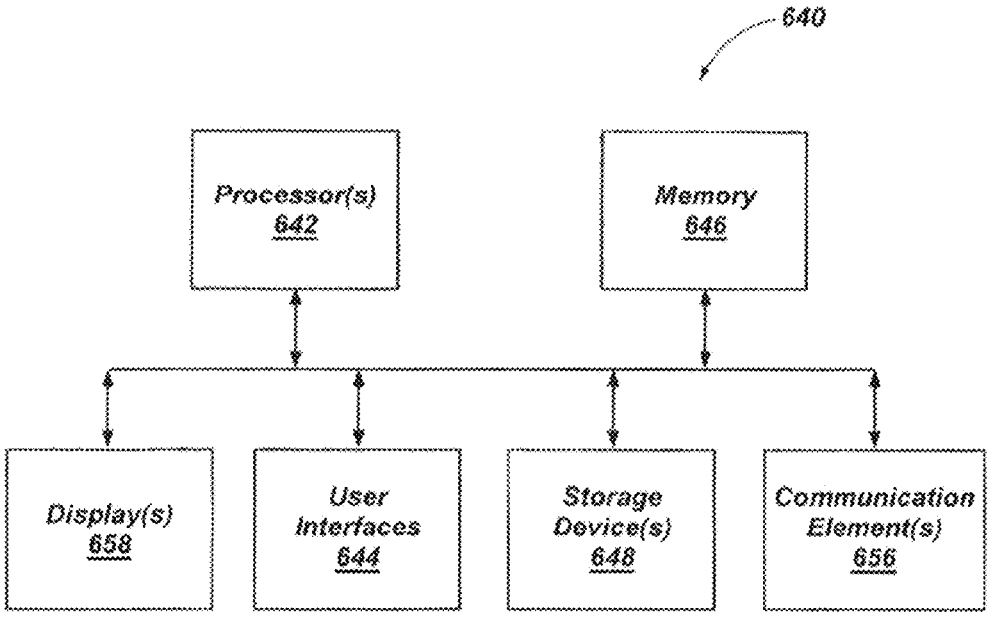
FIG. 9 is a block diagram of a computer for acting as a gaming system for implementing embodiments of wagering games in accordance with this disclosure.

FIG. 9 is a simplified block diagram showing elements of computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially-combined buses, or a common bus.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

The invention claimed is:

1. A system for providing a wagering game at a gaming table, the system including one or more processors, display devices, data input devices, and memory, wherein the display device displays a gaming table layout with a plurality of defined areas representing wagers in the wagering game, wherein the defined areas include wagers having preset winning criteria satisfied by comparison with a single card and wagers having preset winning criteria satisfied by comparison with a plurality of cards; the processor being configured to simulate a unique set of randomly-ordered physical playing cards, wherein executable code in memory is executed to perform the following steps:

receive one or more game wagers from one or more of the participating players, wherein the one or more game wagers are received by being physically positioned in a defined area;

receive data identifying one or more cards displayed from the set of randomly-ordered physical playing cards, wherein the one or more cards are displayed to form a group of community cards in an underlying game unrelated to the provided wagering game;

determine the outcome of the wagers satisfied by comparing at least a first displayed card of the group of community cards with the wager winning criteria;

determine the outcome of the wagers satisfied by comparing all displayed cards of the group of community cards with the wager winning criteria; and settle wagers by one of awarding a payout to the one or more participating players responsive to the satisfaction of a winning criteria, collecting the wager from the one or more participating players responsive to the failure to satisfy a winning criteria.

2. A method of providing a wagering game over a communication network, the network including one or more processors, display devices, data input devices, and memory, wherein the display device displays a gaming table layout with a plurality of defined areas representing wagers in the wagering game, the processor being configured to simulate a unique set of randomly-ordered physical playing cards, the memory storing a player account, the method comprising the steps of:

receiving one or more game wagers for an underlying wagering game from one or more of the participating players, wherein the one or more game wagers are received by being physically positioned in a defined area;

receiving through the one or more data input devices, one or more game wagers for the provided wagering game;

distributing cards from the set of randomly-ordered physical playing cards to form a group of community cards in the underlying wagering game;

displaying on the one or more display devices, the group of community cards;

determining by the one or more processors the outcome of the one or more game wagers on the provided game satisfied by comparing a first card of the group of community cards with the wager winning criteria;

determining by the one or more processors the outcome of the one or more wagers on the provided game satisfied by comparing all cards of the group of community cards with the wager winning criteria; and settling the determined wagers by one of distributing an awarding of a payout to each player account associated with the one or more participating players responsive to the satisfaction of a winning criteria, collecting the wager from each player account associated with the one or more participating players responsive to the failure to satisfy a winning criteria.

* * * * *